US006386401B1

(12) United States Patent
Dodd et al.

(10) Patent No.: US 6,386,401 B1
(45) Date of Patent: May 14, 2002

(54) DISPENSER FOR EXTRUDABLE MATERIAL

(75) Inventors: Robert E. Dodd, Prophetstown; William R. Ellenwood, Jr.; Darrell C. E. Gorman, both of Lyndon, all of IL (US)

(73) Assignee: Prince Castle Inc., Carol Stream, IL (US)

( * ) Notice: Subject to any disclaimer, the term of this patent is extended or adjusted under 35 U.S.C. 154(b) by 0 days.

(21) Appl. No.: 09/714,752

(22) Filed: Nov. 16, 2000

Related U.S. Application Data

(63) Continuation-in-part of application No. 09/494,723, filed on Jan. 31, 2000.

(51) Int. Cl.[7] ..... A67D 5/42
(52) U.S. Cl. ..... 222/391
(58) Field of Search ..... 222/309, 390, 222/391

(56) References Cited

U.S. PATENT DOCUMENTS 3,977,574 A * 8/1976 Thomas ..... 222/391
4,323,176 A * 4/1982 Sartain ..... 222/391
5,197,635 A * 3/1993 Chang ..... 222/309
5,323,931 A * 6/1994 Robards, Jr. et al. ..... 222/309
5,647,515 A * 7/1997 Zwijnenberg et al. ..... 222/391
5,860,572 A * 1/1999 Harrold et al. ..... 222/391

* cited by examiner

*Primary Examiner*—Philippe Derakshani
*Assistant Examiner*—Thach H Bui
(74) *Attorney, Agent, or Firm*—John R. Hoffman

(57) ABSTRACT

A hand dispenser for dispensing an extrudable material includes a housing for holding the extrudable material, along with a pistol grip handle. A trigger member is mounted adjacent the pistol grip handle for movement in a path toward and away therefrom to incrementally effect a metered dispensing of the extrudable material. An adjustable stop cam is mounted in the path of movement of the trigger member. The stop cam has different cam portions engageable by the trigger member and is effective to limit movement of the trigger member to different degrees and, thereby, vary the metered amount of dispensed material. A piston rod has a series of ratcheting teeth on at least two different sides of the rod engageable by a drive pawl operatively associated with the trigger member. The ratcheting teeth in one series thereof has a spacing different from the spacing of the ratcheting teeth in the other series thereof. Therefore, the multiple series of ratcheting teeth provide multiple settings of the dispenser for each setting of the adjustable stop cam.

16 Claims, 3 Drawing Sheets

DISPENSER FOR EXTRUDABLE MATERIAL

RELATED APPLICATIONS

This is a continuation-in-part of co-pending application Ser. No. 09/494,723 which was filed Jan. 31, 2000.

FIELD OF THE INVENTION

This invention generally relates to the art of dispensers and, particularly, to a dispenser for dispensing extrudable material, including means for adjusting the metered amount of material to be extruded.

BACKGROUND OF THE INVENTION

Dispensers for dispensing a viscous or extrudable material have been proposed in a wide variety of designs. Commonly, the extrudable material is dispensed from a cylindrical housing by an advancing piston. When used as hand implements, most such dispensers have one form or another of a pistol grip mechanism, along with a ratcheting or ratchetless device operatively associated with the handle for incrementally advancing the pistol within the cylinder of the dispenser. The ratcheting device may be operated through a trigger member mounted adjacent the pistol grip handle for movement toward and away from the handle.

Although dispensers of the character described for extruding viscous contents have been used for some years, there still is a definite need for a more effective dispenser than has heretofore been available. This has become particularly prevalent in dispensing extrudable condiments, such as ketchup, mustard, tartar sauce and the like, in high volume restaurants or other establishments. In such establishments, quality control is considered critical, whereby precise metered amounts of the condiments are required for dispensing onto a given food product according to very specific "recipe" parameters. In addition, different metered amounts of condiments are required for different food products, and it is inefficient to have a separate dispenser designed to meter a given amount of material for each volume requirement. This invention is directed to satisfying these needs, to solving the problems and to overcoming the limitations of prior dispensing devices by an improved dispenser which is adjustable to dispense varying amounts of metered viscous or extrudable material.

SUMMARY OF THE INVENTION

An object, therefore, of the invention is to provide a new and improved dispenser for dispensing extrudable material, and particularly a dispenser which is meter adjustable.

In the exemplary embodiment of the invention, a hand dispenser is disclosed for dispensing an extrudable material, including a housing for holding the extrudable material, a pistol grip handle and an opening in the housing remote from the pistol grip handle through which the material is extruded. An extruding means is movably mounted in the housing for effecting extruding of the material through the opening. Advancing means are operatively associated with the extruding means for moving the extruding means. The advancing means includes a trigger member mounted adjacent the pistol grip handle for movement in a path toward and away from the pistol grip handle to incrementally advance the extruding means for each actuation of the trigger member and, thereby, effect a metered dispensing of the extrudable material. Generally, metering means are provided for selectively determining one of a plurality of different amounts of material to be dispensed for each actuation of the trigger member toward the pistol grip handle.

Specifically, the metering means include an adjustable stop cam mounted in the path of movement of the trigger member. The stop cam has different cam portions engageable by the trigger member and is effective to limit movement of the trigger member to different degrees and, thereby, vary the metered amount of dispensed material.

As disclosed herein, the stop cam comprises a rotatable shaft extending across the path of movement of the trigger member. The rotatable shaft has the different cam portions about the periphery thereof. The rotatable shaft is mounted on the pistol grip handle, and a manually manipulatable dial fixed to the shaft is exposed exteriorly of the pistol grip handle.

Another feature of the invention is that the extruding means include a piston rod having a series of ratcheting teeth on at least two different sides thereof. The ratcheting teeth are engageable by a drive pawl operatively associated with the trigger member. The ratcheting teeth in one series thereof have a spacing different from the spacing of the ratcheting teeth in the other series thereof. The ratcheting teeth in one series thereof are in exact multiples of the ratcheting teeth in the other series thereof.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
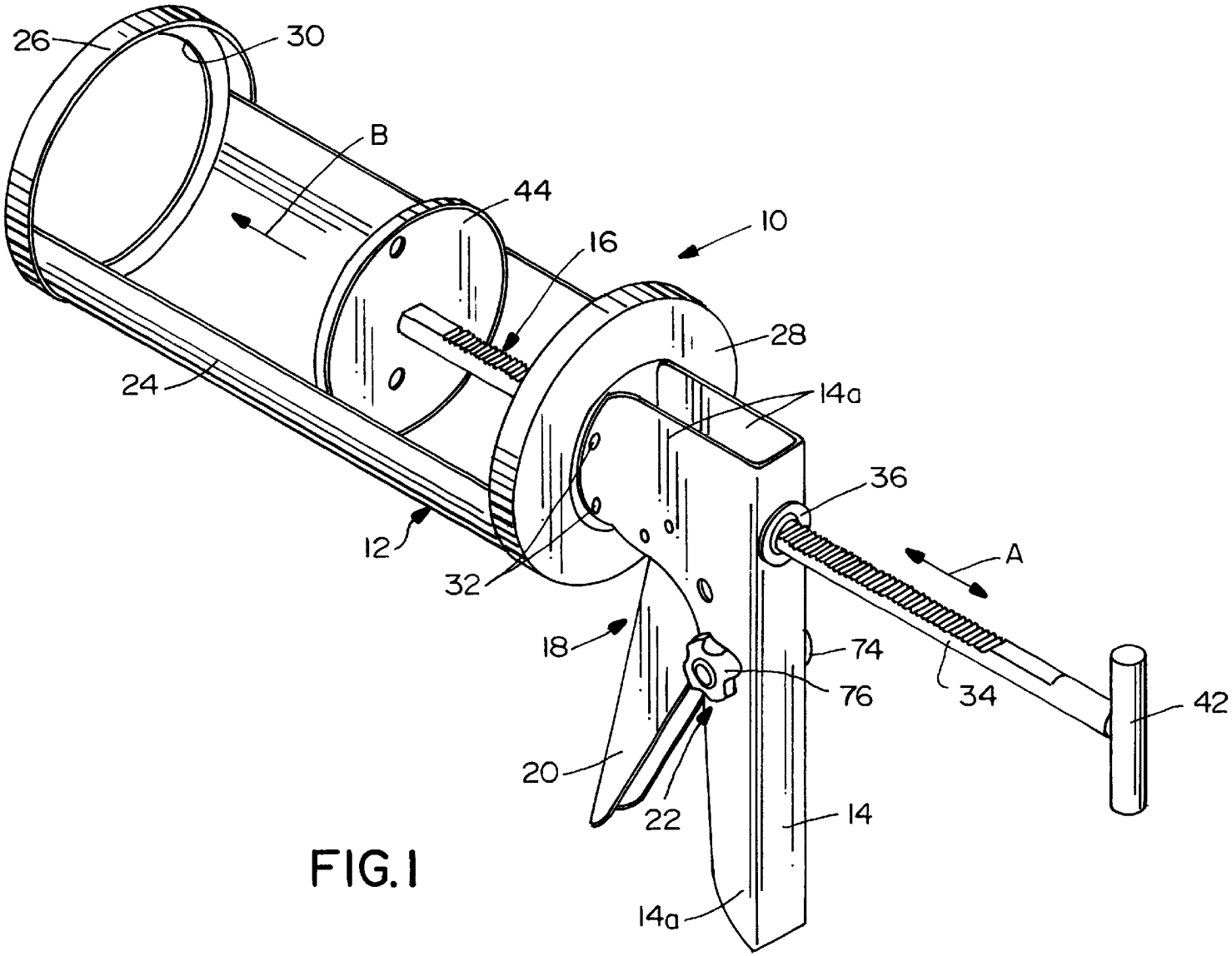
FIG. 1 is a perspective view looking toward the rear of a hand dispenser embodying the concepts of the invention.
Figure 2:
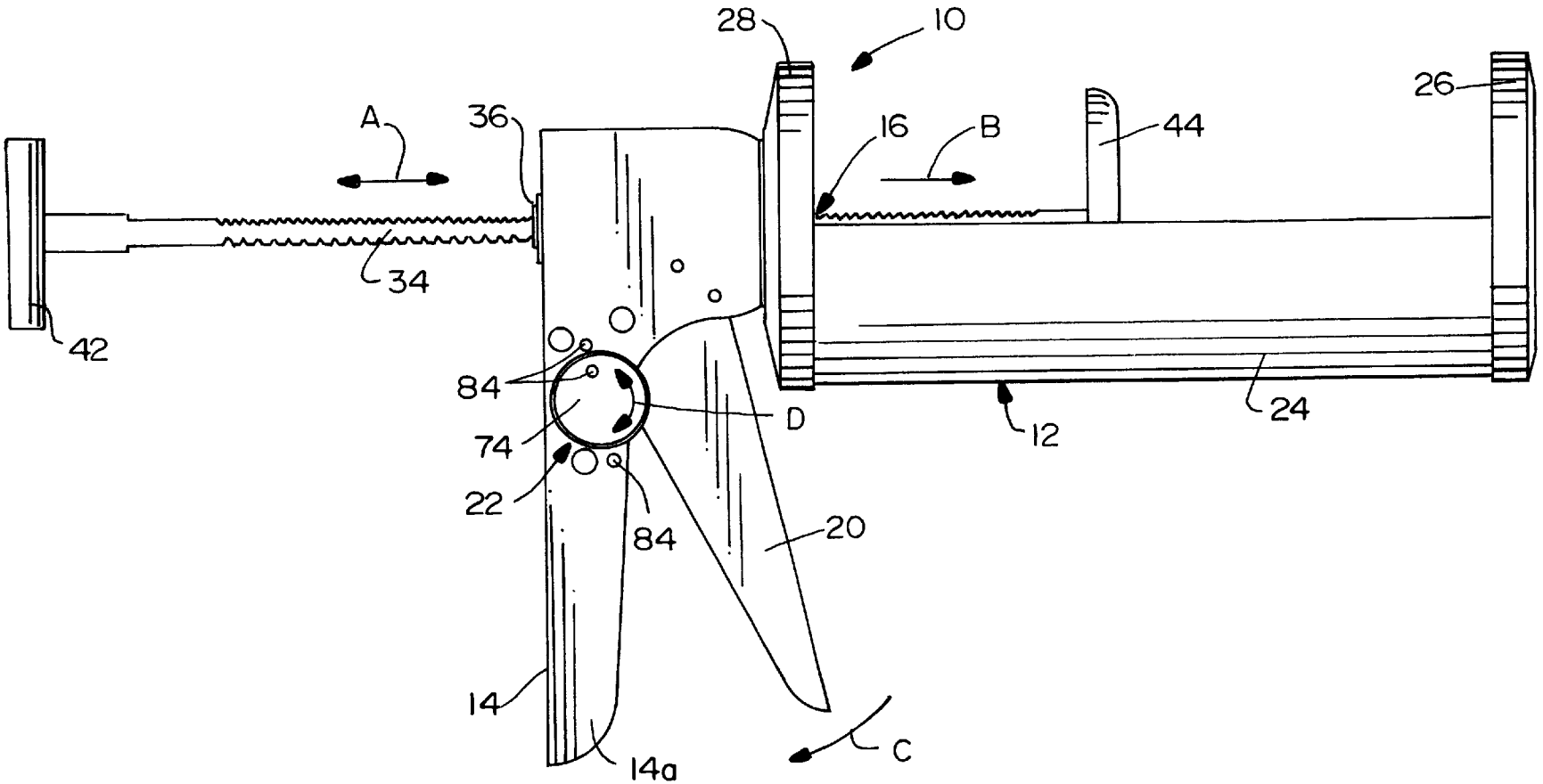
FIG. 2 is a side elevational view of the dispenser, looking at the opposite side of the depiction of FIG. 1.

Referring to the drawings in greater detail, and first to FIGS. 1 and 2, the invention is embodied in a hand dispenser, generally designated 10, for dispensing a viscous or extrudable material, such as fluid condiments including ketchup, mustard, tartar sauce and the like. Generally, the dispenser includes a housing, generally designated 12, having a pistol grip handle 14 at the rear thereof; an extruding means, generally designated 16, movably mounted relative to the housing; advancing means, generally designated 18, and including a trigger member 20 movable toward and away from handle 14, along with other components of the advancing means described hereinafter in relation to FIG. 3; and a metering means, generally designated 22, for selectively determining one of a plurality of different amounts of material to be dispensed for each actuation of trigger member 20 toward pistol grip handle 14.

More particularly, housing 12 of dispenser 10 includes a semi-cylindrical support 24 extending between a front cup-shaped plate 26 and a rear cup-shaped plate 28. Front plate 26 has an opening 30 remote from pistol grip handle 14, and rear plate 28 has an opening through which the extruding means extends, as will be seen hereinafter. The entire housing, including support 24, end plates 26 and 28 and pistol grip handle 14 can be fabricated of stamped and formed sheet metal material. The handle is fixed to rear plate 28, as by riveting 32 (FIG. 1). The pistol grip handle is generally U-shaped in cross-section to define side walls 14*a* between which trigger member 20 is movably mounted.

In actual practice, a container (not shown) of extrudable material is mounted within semi-cylindrical support 24 between cup-shaped end plates 26 and 28. The container may be cylindrical with a movable piston plate or it may be collapsible, and the container may be disposable or reusable. Typically, the container has a nozzle which projects through opening 30 in front end plate 26 and through which the extrudable material is dispensed.

Figure 3:
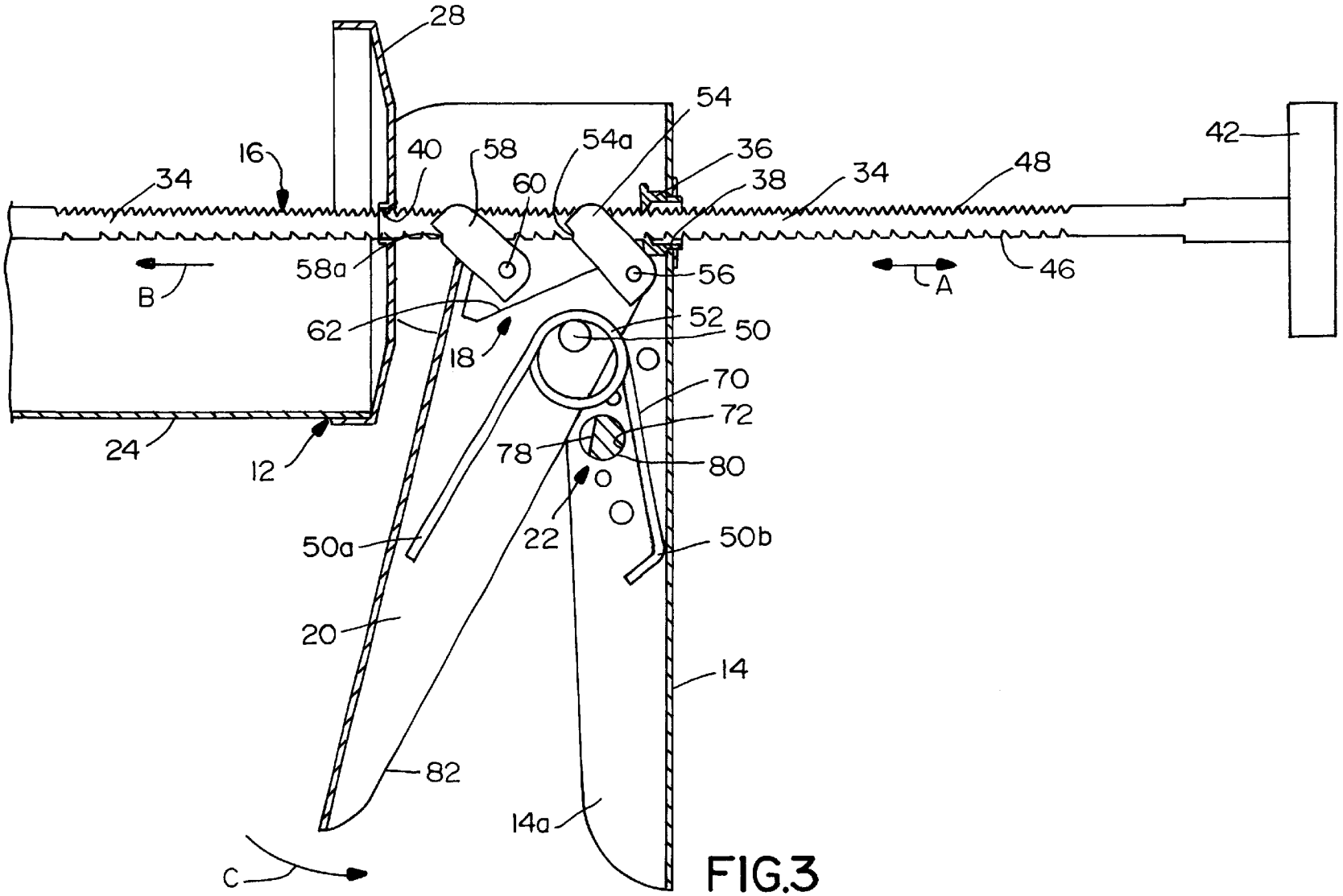
FIG. 3 is a fragmented vertical section through the dispenser in the pistol grip/trigger area thereof.

Referring to FIG. 3 in conjunction with FIGS. 1 and 2, extruding means 16 includes a piston rod 34 extending through a bushing 36 in an opening 38 in pistol grip handle 14 and through a center hole 40 in rear plate 28 of housing 12. The piston rod is advancible and returnable in the direction of double-headed arrow "A". The piston rod has a manually graspable handle 42 at its rear end and a disk-shaped piston 44 at its front end. Piston 44 is sized complementary to the diameter of semi-cylindrical support 24 and is operatively associated with the container of extrudable material for extruding the material from the container when piston rod 34 and piston 44 are advanced in the direction of arrow "B". Finally, piston rod 34 includes a series of ratcheting teeth 46 on one side thereof and a second series of ratcheting teeth 48 on an opposite side thereof. It can be seen clearly in FIG. 3 that ratcheting teeth 46 are spaced wider than ratcheting teeth 48. Ratcheting teeth 48 are in substantially exact multiples of ratcheting teeth 46 longitudinally of piston rod 34. The piston rod is rotatable about its longitudinal axis by grasping handle 42 to bring one or the other of the series of ratcheting teeth in alignment with the advancing means described below.

Referring primarily to FIG. 3, trigger member 20 is pivotally mounted to pistol grip handle 14 by a mounting pivot post 50. A coil spring 52 surrounds the pivot post and has opposite ends 50*a* and 50*b* for engaging the insides of trigger member 20 and pistol grip handle 14, respectively, to bias the trigger member away from the handle.

In addition to trigger member 20, advancing means 18 includes a drive pawl 54 pivotally connected to the trigger member at 56. The drive pawl is generally U-shaped in cross-section to embrace piston rod 34 and includes a cross edge 54*a* which engages with ratcheting teeth 46 (or 48) of the piston rod. A spring (not visible in the drawing) is operatively associated between drive pawl 54 and the upper end of trigger member 20 to bias edge 54*a* of the drive pawl into engagement with the ratcheting teeth of the piston rod. Therefore, each incremental actuation of trigger member 20 toward pistol grip handle 14 in the direction of arrow "C" dispenses a metered amount of extrudable material from the dispenser, as piston rod 34 is advanced forwardly an incremental amount in the direction of arrow "B".

The advancing means also includes stop means for preventing piston rod 34 and piston 44 from backing-up during each incremental advancement thereof by squeezing trigger member 20. More particularly, a stop pawl 58 is pivotally mounted to pistol grip handle 14, at 60, within a cut-out 62 in trigger member 20. Like drive pawl 24, stop pawl 58 is generally U-shaped in cross-section to embrace piston rod 34 and has a cross edge 58*a* for engaging the ratcheting teeth of the piston rod. Again, a spring (not visible in the drawings) is operatively associated between stop pawl 58 and pistol grip handle 14 to bias the stop pawl into engagement with the ratcheting teeth of the piston rod.

When it is desired to withdraw piston rod 34 and piston 44 rearwardly opposite the direction of arrow "B", the piston rod is rotated by using handle 42 to bring one of the smooth side surfaces of the piston rod into engagement with drive pawl 54 and stop pawl 58 so that the pawls do not engage the ratcheting teeth. The two different series of ratcheting teeth of different spacings are provided to "fine-tune" the dispenser so that there is no lost motion between drive pawl 54 and piston rod 34. In other words, it is desirable to have the piston rod incrementally move during the entire time that trigger member 20 moves in each of its cycles of operation. In addition, the two series of ratcheting teeth double the settings of the dispenser for each setting of adjustable stop cam 70.

As stated above, the invention contemplates the provision of metering means 22 for selectively determining one of a plurality of different amounts of material to be dispensed for each actuation of trigger member 20 toward pistol grip handle 14. More particularly, and still referring to FIG. 3, an adjustable stop cam in the form of a rotatable shaft 70 extends through holes 72 in side walls 14*a* of pistol grip handle 14. The cam shaft has a dial 74 (FIG. 2) fixed to one end exteriorly of the pistol grip handle and a lock nut 76 (FIG. 1) threaded onto the opposite end of the cam shaft exteriorly of the piston grip handle. The nut is tightened sufficiently to hold the cam shaft in a position of adjustment, but sufficiently loose to allow an operator to rotate the cam shaft.

Cam shaft 70 extends across the path of movement of trigger member 20 and has different cam portions 78 and 80 engageable by the trigger member and effective to limit movement of the trigger member to different degrees and, thereby, vary the metered amount of dispensed material. In the exemplary embodiment of the invention, cam portion 78 is formed by a flat on the cam shaft, and cam portion 80 is formed by the remaining cylindrical portion of the shaft. Of course, other cross configurations of the cam shaft can be provided to provide additional and different metered amounts of dispensed material. When flat 78 is aligned with inside edges 82 of trigger member 20, the trigger member can move toward pistol grip handle 14 in the direction of arrow "C" a greater amount or distance than if rounded periphery 80 is aligned with or faces the trigger member. When an operator wishes to change the metered amount of dispenses material, dial 74 (FIG. 2) simply is grasped and rotated in the direction of double-headed arrow "D" (FIG. 2) to bring a different cam portion of the cam shaft into position facing the trigger member. Appropriate indicia means 84 (FIG. 2) can be provided on dial 74 and pistol grip handle 14 to indicate which cam portion on cam shaft 70 has been rotated in position of engagement by the trigger member.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A hand dispenser for dispensing an extrudable material, comprising:

housing means for holding the extrudable material and including a pistol grip handle and an opening in the housing means remote from the pistol grip handle through which the material is extruded;

an extruding means movably mounted relative to the housing means for effecting extruding of the material through the opening;

advancing means operatively associated with the extruding means for moving the extruding means, including a trigger member mounted adjacent the pistol grip handle for movement in a path toward and away from the pistol grip handle to incrementally advance the extruding means for each actuation of the trigger member and, thereby, effect a metered dispensing of the extrudable material;

metering means for selectively determining one of a plurality of different amounts of material to be dispensed for each actuation of the trigger member toward the pistol grip handle, including an adjustable stop cam mounted in the path of movement of the trigger member, the stop cam having different discrete cam portions engageable by the trigger member and effective to limit movement of the trigger member to different degrees and, thereby, vary the metered amount of dispensed material; and said extruding means including a piston rod having a series of ratcheting teeth on at least two different sides of the rod engageable by a drive pawl operatively associated with said trigger member, the ratcheting teeth in one series thereof having a spacing different from the spacing of the ratcheting teeth in the other series thereof;

whereby said multiple series of ratcheting teeth on the piston rod provide for multiple settings of the dispenser for each setting of the metering means.

2. The hand dispenser of claim 1 wherein said stop cam comprises a rotatable member having said different cam portions about the periphery thereof.

3. The hand dispenser of claim 2 wherein said stop cam comprises a rotatable shaft extending across the path of movement of the trigger member.

4. The hand dispenser of claim 2 wherein said stop cam is rotatably mounted on the pistol grip handle.

5. The hand dispenser of claim 4, including a manually manipulatable dial fixed to the rotatable stop cam and exposed on the exterior of the pistol grip handle.

6. The hand dispenser of claim 1 wherein the ratcheting teeth in said one series thereof are in substantially exact multiples of the ratcheting teeth in the other series thereof.

7. A hand dispenser for dispensing an extrudable material, comprising:

housing means for holding the extrudable material and including a pistol grip handle having a generally U-shaped cross-section, and an opening in the housing means remote from the pistol grip handle through which the material is extruded;

an extruding means movably mounted relative to the housing means for effecting extruding of the material through the opening;

advancing means operatively associated with the extruding means for moving the extruding means, including a trigger member mounted within the U-shaped pistol grip handle for movement in a path toward and away from the pistol grip handle to incrementally advance the extruding means for each actuation of the trigger member and, thereby, effect a metered dispensing of the extrudable material;

a cam shaft rotatably mounted on the pistol grip handle and extending across the path of movement of the trigger member, the cam shaft having different discrete peripheral cam portions engageable by the trigger member and effective to limit movement of the trigger member to different degrees and, thereby, vary the metered amount of material to be dispensed for each actuation of the trigger member toward the pistol grip handle;

a manually manipulatable dial fixed to the rotatable cam shaft and exposed on the exterior of the pistol grip handle; and said extruding means including a piston rod having a series of ratcheting teeth on at least two different sides of the rod engageable by a drive pawl operatively associated with said trigger member, the ratcheting teeth in one series thereof having a spacing different from the spacing of the ratcheting teeth in the other series thereof;

whereby the multiple series of ratcheting teeth on the piston rod provide for multiple settings of the dispenser for each setting of the cam shaft.

8. The hand dispenser of claim 7 wherein the ratcheting teeth in said one series thereof are in substantially exact multiples of the ratcheting teeth in the other series thereof.

9. A hand dispenser for dispensing an extrudable material, comprising:

housing means for holding the extrudable material and from which the material is extruded, including a pistol grip handle;

a trigger member mounted adjacent the pistol grip handle for movement in a path toward and away from the pistol grip handle to effect a metered dispensing of the extrudable material;

an adjustable stop cam mounted in the path of movement of the trigger member, the stop cam having different discrete cam portions engageable by the trigger member and effective to limit movement of the trigger member to different degrees and, thereby, vary the metered amount of dispensed material; and extruding means with a piston rod having a series of ratcheting teeth on at least two different sides of the rod engageable by a drive pawl operatively associated with said trigger member, the ratcheting teeth in one series thereof having a spacing different from the spacing of the ratcheting teeth in the other series thereof;

whereby the multiple series of ratcheting teeth on the piston rod provide multiple settings of the dispenser for each setting of the adjustable stop cam.

10. The hand dispenser of claim 9 wherein said stop cam comprises a rotatable member having said different cam portions about the periphery thereof.

11. The hand dispenser of claim 10 wherein said stop cam comprises a rotatable shaft extending across the path of movement of the trigger member.

12. The hand dispenser of claim 10 wherein said stop cam is rotatably mounted on the pistol grip handle.

13. The hand dispenser of claim 12, including a manually manipulatable dial fixed to the rotatable stop cam and exposed on the exterior of the pistol grip handle.

14. The hand dispenser of claim 9 wherein the ratcheting teeth in said one series thereof are in substantially exact multiples of the ratcheting teeth in the other series thereof.

15. A hand dispenser for dispensing an extrudable material, comprising:

housing means for holding the extrudable material and from which the material is extruded, including a pistol grip handle;

a trigger member mounted adjacent the pistol grip handle for movement in a path toward and away from the pistol grip handle to effect a metered dispensing of the extrudable material; and extruding means including a piston rod having a series of ratcheting teeth on at least two different sides of the rod engageable by a drive pawl operatively associated with said trigger member, the ratcheting teeth in one series thereof having a spacing different from the spacing of the ratcheting teeth in the other series thereof.

16. The hand dispenser of claim 15 wherein the ratcheting teeth in said one series thereof are in substantially exact multiples of the ratcheting teeth in the other series thereof.

* * * * *